United States Patent [19]

Matsunaga et al.

[11] 4,039,321

[45] Aug. 2, 1977

[54] METHOD FOR PRODUCING A GRAIN-ORIENTED ELECTRICAL STEEL BY AN OXYGEN-BLOWN CONVERTOR

[75] Inventors: Hisashi Matsunaga; Yosinobu Horii; Masaya Higasiguchi, all of Himeji, Japan

[73] Assignee: Nippon Steel Corporation, Tokyo, Japan

[21] Appl. No.: 645,354

[22] Filed: Dec. 30, 1975

Related U.S. Application Data

[63] Continuation-in-part of Ser. No. 474,161, May 29, 1974, abandoned.

[30] Foreign Application Priority Data

May 31, 1973 Japan ..... 48-61194

[51] Int. Cl.[2] ..... C21C 7/06

[52] U.S. Cl. ..... 75/60; 75/53

[58] Field of Search ..... 75/60, 53, 54, 56

[56] References Cited

U.S. PATENT DOCUMENTS 2,983,598 5/1961 Wheatley ..... 75/56

*Primary Examiner*—Peter D. Rosenberg

*Attorney, Agent, or Firm*—Toren, McGeady and Stanger

[57] ABSTRACT

A method for producing steel for grain-oriented electrical steel sheet or strip in an oxygen-blown convertor, which comprises preliminarily adjusting the manganese content of molten pig iron to be charged into the convertor to not more than 0.35%, and blowing the thus adjusted molten pig iron in the convertor to obtain molten steel containing not more than 0.065% Mn, not less than 0.03% C and not more than 1000 ppm (O).

5 Claims, 5 Drawing Figures

◉ INVENTIVE METHOD (ONE-TIME BLOWING)
○ TWO-TIME BLOWING (INTERMEDIATE SLAG-OFF)
ZONE OFTEN SEEN WHEN THE PRESENT INVENTIVE METHOD (ONE-TIME BLOWING) IS APPLIED
ZONE OFTEN SEEN WHEN TWO-TIME BLOWING (INTERMEDIATE SLAG-OFF) IS APPLIED
MAGNETIC FLUX DENSITY B8
1.87
1.86
1.85
1.84
1.83
1.82
1.81
1.80
700
800
900
1000
1100
1200
BLOWING-OFF [O] PPM

METHOD FOR PRODUCING A GRAIN-ORIENTED ELECTRICAL STEEL BY AN OXYGEN-BLOWN CONVERTOR

CROSS-REFERENCE TO RELATED APPLICATIONS

This application is a Continuation-in-Part of co-pending application Ser. No. 474,161, filed on May 29, 1974 and now abandoned.

BACKGROUND OF THE INVENTION

1. Field of the Invention

The present invention relates to a method for producing steel suitable for grain-oriented electrical steel sheet or strip by an oxygen-blown convertor (hereinafter called simply "converter").

2. Description of the Prior Art

A grain-oriented electrical steel sheet having excellent magnetization characteristics in the rolling direction can be obtained by controlling the so-called secondary crystallization phenomenon in which the primary recrystallization grain having {110}<100> orientation grows selectively, and thus, by increasing the proportion of the grains having {110}<100> orientation during the final annealing. For this purpose, it is necessary particularly to form a precipitated dispersion suitable for the secondary recrystallization. As for the impurity elements for forming this precipitated dispersion, one or more of Mn, S, Al, Se, N, Sb, V, Cu, P, Ti and Cr are used and, among them, Mn is the most commonly used.

In order to effect full solid dissolution of the MnS as is commonly done during the slab treating step, it is necessary to maintain the content of Mn to less than a certain value. On the other hand, in some cases, MnS is not used positively for forming the precipitated dispersion, and in such cases, it is necessary to further lower the content of Mn. It has been found from the above facts that a manganese content of not more than 0.075% in the steel is desirable. In actual practice, however, since this value is a ladle analysis and pick-up of Mn is caused in the ladle, the content of Mn as a blown-off Mn content should be less the above value.

In recent years the convertor steel-making process has been largely and actively introduced for refining molten steel, and various advantages are thought to be obtained by oxygen-blowing steels for grain-oriented electrical steel sheets in a convertor.

For molten steel having a low blown-off Mn content as mentioned above by the conventional convertor blowing technics, it is natural that the [O] content in the steel is high, so that inclusions increase in the steel.

If a large amount of inclusions is present in the molten steel, a poor precipitated dispersion of MnS is obtained and unsatisfactory secondary recrystallization takes place, so that the magnetization characteristics deteriorate. Thus it is necessary to avoid increase of the [O] content in the molten steel prior to deoxidation, and for this purpose, it is necessary to maintain a slightly high blown-off content of C depending on the C-O equilibrium.

Thus under the above situations, studies have been made of the convertor steel-making process in order to solve the above problems for preparation of molten steel for grain-oriented electrical steel sheet, and as a result, attempts have been increasingly made to produce such steel in a convertor.

For example, a Japanese patent publication discloses a convertor blowing process, wherein intermediate slag-off is performed while maintaining the bath temperature in the range of 1350° and 1450° C at a carbon content between 1.5 and 3.0% in the molten steel in the first blowing stage. Then, in the second blowing stage, a soft blowing is performed at a point wherein the carbon content in the molten steel is not less than 0.05% to obtain a final Mn content of not more than 0.055%. By this method, the magnetic property levels required were satisfied and advantages deriving from the convertor processes were effectively utilized. However, the following disadvantages accompanied the process.

According to the above prior art, a low-Mn steel is obtained by increasing the MnO % in the slag in the second blowing stage, and the soft blowing is performed for the purpose of increasing the percent of FeO in the slag, so that the [O] content in the molten steel is increased. Thus, it is not possible to completely and stably obtain a final product having a magnetic property level as required for present day uses. Further, it requires a skilled technic to control the Mn content to a predetermined low value by the soft blowing in the convertor, and the Mn content often deviates from the predetermined value and thus reblowing is compulsory. However, reblowing causes an increase in the N content in the steel and the following serious problems are caused.

In recent years, "a continuous casting process" in which molten steel is continuously cast into molds has been adopted for the purpose of improving productivity and assuring uniform steel quality. But, if the content of nitrogen in the molten steel to be continuously cast is high, local swellings called blisters are caused after the cold rolling and heat treatment in the production process of a grain-oriented electrical steel sheet and the blisters damage the appearance of the final products and lower the space factor of the steel sheet.

Still further, as the soft blowing is performed in order to obtain a low-Mn steel and the intermediate slag-off is performed prior to the soft blowing (the second blowing stage), the tapping yield is lowered and the blowing time is increased.

SUMMARY OF THE INVENTION

One of the objects of the present invention is to provide a convertor steel-making process for producing steel which fully satisfies the required magnetic properties, which is characterized by lowering the content of [O] in the molten steel for preparing low-Mn steel in a convertor.

Another object of the present invention is to provide a method for lowering efficiently the content of Mn in the molten steel.

Still another object of the present invention is to provide molten steel for obtaining steel products free from the above blisters by constantly maintaining the content of N in the molten steel at the time of tapping from the convertor to a low level and by continuous casting of the molten steel.

Another object of the present invention is to remarkably shorten the blowing time as compared with the convertor blowing of grain-oriented electrical steel sheet disclosed in the Japanese patent publication Sho 48-19044, thus improving the productivity.

Still another object of the present invention is to improve the steel tapping yield by minimizing the iron loss in the convertor blowing.

Other objects of the present invention will be clear from the following descriptions.

Particularly, we have found that these objects can be accomplished by decreasing the content of manganese in molten pig iron used in steel making and which is refined in a blast furnace to 0.1 to 0.35%, and preferably from 0.10 to 0.30%, in a treating vessel before blowing said pig iron in a convertor. Thus, ordinarily, molten pig iron contains about 0.5 to 0.7% manganese before charging to a convertor. When the molten pig iron with the reduced manganese content is blown in a conventional convertor, the amount of manganese picked up from the MnO in the slag is remarkably decreased. Consequently, special operations, e.g., an intermediate slag-off process, soft blowing in the second blowing stage, and reblowing to control the manganese content to a low value, as disclosed in Japanese patent publication No. Sho 48-19044, are not necessary at all.

More particularly, the present method is carried out by bringing conventional molten pig iron into contact with iron oxide powder having a bulk density between 0.3 and 1.0 to obtain not less than 4.0% carbon and less than 0.35% manganese before the pig iron is charged to a convertor. The thus treated pig iron is subjected to oxygen blowing in the convertor without discharging the slag produced during the oxygen blowing from the convertor, to produce a molten steel containing not more than 0.075% manganese, not less than 0.03% carbon, and not more than 1.000 ppm oxygen.

DESCRIPTION OF THE PREFERRED EMBODIMENTS

Figure 1:
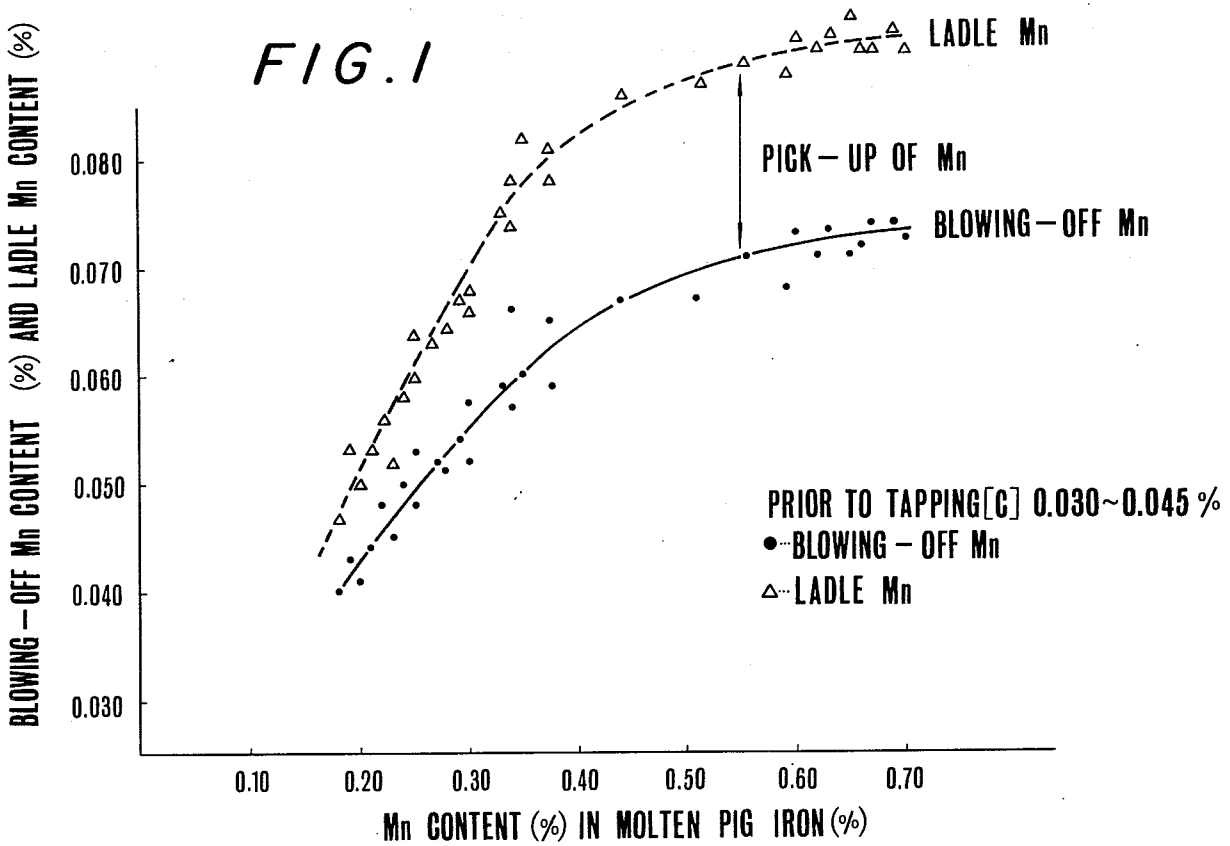
FIG. 1 is a graph showing the relation among the Mn contents in molten pig iron, the blown-off Mn contents and the Mn contents in a ladle.

FIG. 1 is a graph showing the relationship between the molten pig iron (low Mn contents are attained by Mn-removing treatment), blown-off Mn contents in the molten steel obtained by ordinary blowing of the molten pig iron, and the pick-up of Mn from MnO in the slag (the C content prior to tapping is 0.030 to 0.045%).

Based on FIG. 1, it has been found that since the content of manganese in the finished steel becomes lower and the pick-up of manganese is also decreased, when the content in the molten pig iron is decreased, molten steel having not more than 0.075% Mn is obtained which is suitable for use to prepare grain-oriented electrical steel. Particularly, the content of the molten pig iron which ordinarily possesses a content from 0.5 to 0.7% is reduced to 0.10 to 0.35% and preferably to 0.10 to 0.30%, and the pig iron is then charged to a convertor to be subjected to ordinary convertor blowing.

The blown-off Mn content attained by this method is 0.065 when 0.35% Mn is present in the molten pig iron with a pick-up of Mn of about 0.010%. Thus it is very seldom that the final Mn content exceeds 0.075% even when the Mn pick-up is added to the blown-off Mn content. If the Mn content is further lowered to not more than 0.30%, the blown-off Mn content and the Mn pick-up are also reduced so that it is possible to maintain Mn contents of not more than 0.075%.

For the above reasons, the Mn content in the molten pig iron is limited to not more than 0.35%, and preferably not more than 0.30%.

As a result, the additional oxygen blowing called as "soft blowing" in the second blowing stage for manganese removal as adopted in the Japanese patent publication Sho 48-19044 is unnecessary in the present invention and yet it is possible to maintain the blown-off [O] content to not more than 1000 ppm and obtain steels having excellent magnetic properties.

Figure 2:
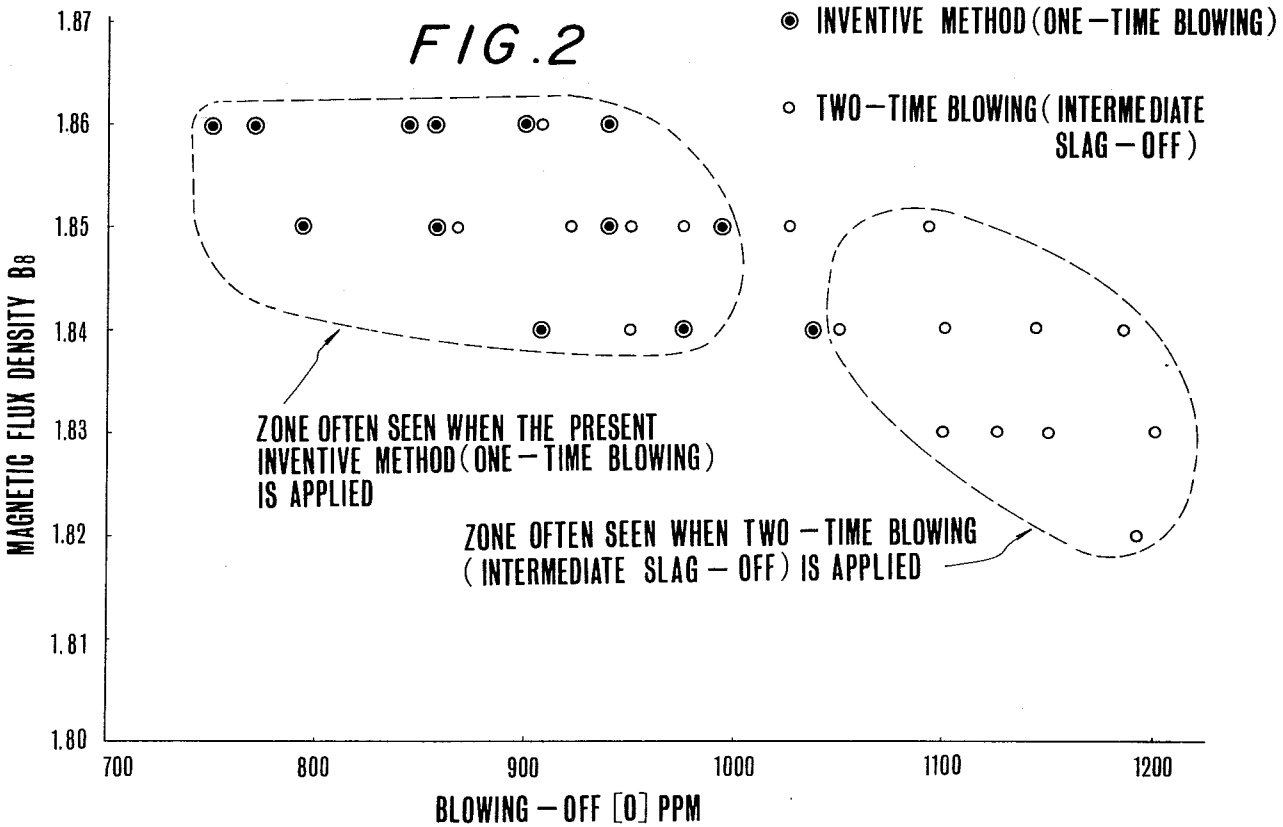
FIG. 2 is a graph showing the relation between blow-off [O] contents and magnetic flux densities ($B_8$).

FIG. 2 is a comparison of the relationship between the blown-off [O] contents and the magnetic flux densities ($B_8$) attained by the prior art of the Japanese patent publication Sho 48-19044 and the present invention in which molten pig iron containing not more than Mn was used.

As clearly understood from FIG. 2, the blown-off [O] contents are generally above 1050 ppm in the prior art while the blown-off [O] contents in the present invention are lower than 1000 ppm which indicate a higher level of stability of the magnetic property $B_8$. The results of the present invention shown in FIG. 2 are those obtained by conducting the convertor blowing according to FIG. 4 and subsequently conducting an ordinary two-step cold rolling (plate thickness 0.3 mm). The steel has a controlled composition range of 0.005 to 0.055% C, 2.95 to 3.25% Si, 0.035 to 0.072% Mn and 0.015 to 0.027 % S.

Figure 3:
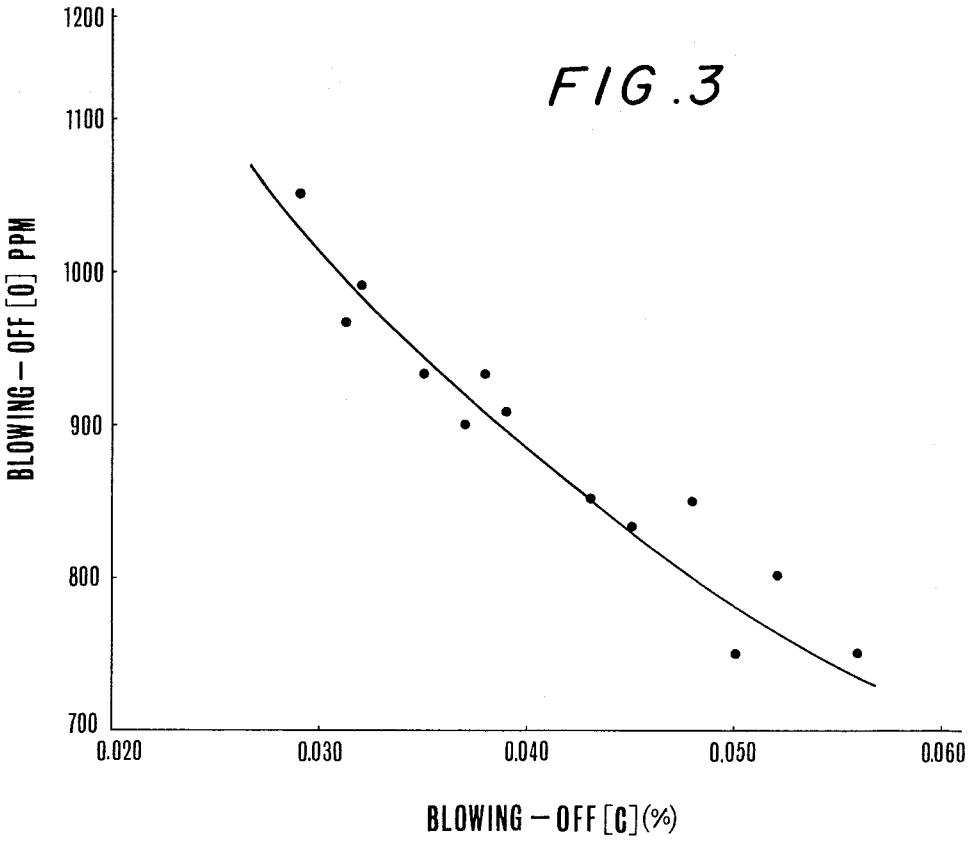
FIG. 3 shows the relation between blown-off C contents and blown-off [O] contents.

FIG. 3 shows the relation between the blown-off C contents and the blown-off [O] contents in the present invention, in which the C content was maintained more than 0.03% in order to restrict the [O] content to not more than 1000 ppm. If the C content is too high, subsequent carbon removal is the main cost factor and an upper limit of about 0.06% is desirable. Accordingly, the lower limit of the oxygen content in the finished steel is about 400 ppm.

According to the prior art of the Japanese patent publication Sho 48-19044, it is very important to strictly control the blown-off Mn content in the convertor blowing so that an adjustment blowing is necessitated in the final stage of blowing considering the C content, the Mn content and the bath temperature. However, this adjustment blowing permits a larger amount of N from the air to be introduced into the molten steel. Thus allowing 30 to 50 ppm of N initially and a subsequent pick-up of N of about 10 ppm, the N content prior to casting is 40 to 60 ppm.

Whereas according to the present invention, no adjustment blowing is required and almost no contact of air and the molten steel occurs so that it is possible to minimize the N intrusion and obtain steels containing a very small amount of N, namely, not more than about 35 ppm. In spite of the subsequent pick-up of N, the N content prior to casting is not more than 45 ppm in the present invention.

In recent years, continuous casting technics have been increasingly used for the purpose of increasing the production efficiency in steel making and assuring a homogeneous steel quality. However, the N content in the molten steel before casting is more than 50 ppm, and the defects of local swellings called "blisters" appear after the cold rolling and heat treatment in the production process of the grain-oriented electrical steel sheet from the continuously cast steel slab as mentioned hereinbefore. The blister is not due to the N content alone, but it is related also to the amount of hydrogen, oxygen, etc., and this defect is remarkable in the case of a low Al content. It has been commonly considered that blister cannot be prevented by modern technics when the N content in the steel exceeds 50 ppm even when the hydrogen and oxygen contents are reduced.

Thus when the molten steel obtained by the prior art of the Japanese patent publication Sho 48-19044 is continuously cast, the blisters appear unavoidably, whereas according to the present invention, the blisters are effectively prevented even when the steel is continuously cast.

In general, molten pig iron refined in a blast furnace contains from 0.5 to 0.7% Mn and this Mn content is reduced to not more than 0.35%, namely, 0.10 to 0.35% and preferably 0.10 to 0.30% by the preliminary treatment in the present invention as explained hereinunder.

For lowering the manganese content in the molten pig iron, chlorine or carbon tetrachloride may be introduced into the molten pig iron, but in this case, equipment for treating the generating chlorine gas is required. Another method is treating the pig iron in the presence of an oxidizing slag. However, the ordinary treatment equipment does not have a regular thermal energy supplying device so that melting of the acid slag must be effected by the sensible heat of the molten pig iron. As for the slag making composition for this oxidizing slag, iron oxides, such as, scale, sinters and iron ores, lime stone, silica stone fluorite, etc., may be used, and lime stone, silica stone and fluorite may function as a slag adjusting agent (for lowering the melting point of the slag). However, when the particle size of the iron oxide is too large or when the amount charged is excessive, the slag making materials are not fully melted, thus causing unstable removal of manganese, elongation of the treating time and requiring the reheating of the molten pig iron.

On the other hand, when an iron oxide having 0.3 to 1.0 bulk density together with, if necessary, the slag adjusting agent is charged and the heat is forcedly stirred, it is possible to reduce the manganese content in the molten pig iron only by the sensitive heat of the molten pig iron. This treatment is conducted in a treating vessel having a forced stirring device. As for this stirring device, various types of devices, such as, an impellar stirring device, a gas bubbling device, a gas injection device and other devices which can stir the molten pig iron and slag making materials may be used. By stirring the molten pig iron and slag making materials in this way, the slag making materials are fully melted to form an oxidizing slag and a part of the manganese content in the molten pig iron is transferred into the slag.

In the above treatment, the slag making materials to be charged into the treating vessel should be materials which can be fully melted by the sensible heat of the molten pig iron. For this purpose, a slag making material of bulk density within a specific range of 0.3 to 1.0 is used, which material is melted into a state favorable to the refining at a temperature desirable for the treatment. Iron oxide of 0.3 to 1.0 bulk density possesses a remarkably large surface area so that it exhibits excellent solubility. However, if the bulk density of the iron oxide exceeds 1.0, the solubility of the iron oxide lowers so that the manganese removal efficiency deteriorates and becomes unstable. On the other hand, iron oxide having a bulk density less than 0.3 is not easily obtainable and thus uneconomical, although its solubility is good. As for the iron oxide having a bulk density in the above range, powdery iron oxides recovered from dust or sludge coming from steel making plants, or recovered from the treatment of acid pickling waste liquid, or powdery iron oxide, such as, rod oxide may be used.

Also, it is desirable that lime stone, silica stone and fluorite which are charged as the slag making material or slag adjusting material are readily melted by the sensible heat of the molten pig iron. Therefore, lime stone and silica sand, which are hard to melt, are used in the form of a powder or granulated, and in this case it is desirable that the particle size of lime stone and silica stone be divided as finely as possible in order to increase their solubility. The amount of the iron oxide having a bulk density in the above range charged is adjusted depending on conditions, such as, the manganese content in the molten pig iron and the manganese removal efficiency. For example, when 15 Kg per ton of pig iron oxide having 0.4 bulk density is charged, the manganese removal is about 40 to 50%, 20 kg per ton of pig iron of iron oxide gives about 50 to 60% manganese removal, and 25 kg per ton of pig iron of iron oxide gives about 60 to 70% manganese removal. In this way the manganese removal efficiency can be controlled also by controlling the charging proportion and amount of the slag making materials.

As noted above, if the oxidizing slag and the molten pig iron are contacted with each other, the content of manganese is decreased in the molten pig iron and also the content of silicon is naturally decreased in said molten pig iron. However, because the silicon is an important heat source when oxygen blowing is carried out in a convertor in the subsequent processes, it is undesirable to decrease the content of silicon too much. The present inventors have found that the above-mentioned problem can be solved by making the manganese content not less than 0.10% when the content of manganese is decreased to less than 0.35% in the molten pig iron, and that, in case of the above-mentioned convertor blowing, the heat source, for example, ferrosilicon, etc. need not be added. Further, if the content of the manganese in the molten pig iron, as refined in a blast furnace, is decreased to 0.10 to 0.35% before the pig iron is charged into a convertor, the lower limit of the manganese in the finished steel, obtained by ordinary oxygen blowing in the convertor is about 0.01%.

The following is an example of the manganese removal treatment of molten pig iron.

Iron oxide (red oxide) having a bulk density of 0.4 was charged at a rate of 20 kg per ton of pig iron to a treating vessel provided with a porous plug suitable for gas bubbling, and 70 tons of molten pig iron containing 4.2% C, 0.60% Mn, 0.60% Si, 0.110% P and 0.025% S was charged, and then stirring was effected by bubbling argon gas through the melt. The charging temperature of the molten pig iron was 1350° F but the temperature after the treatment was about 1300° C and the Mn content was 0.25 with a manganese removal of 58%.

Figure 5:
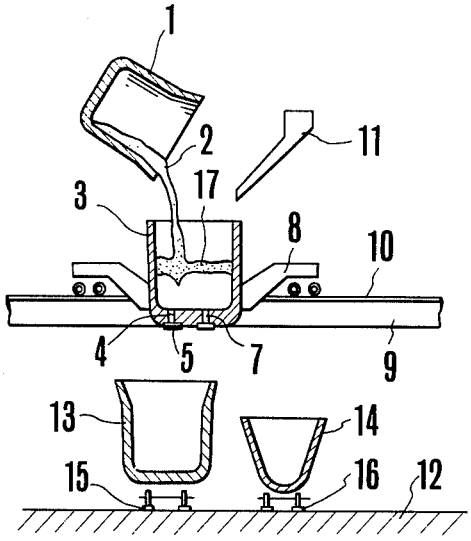
FIG. 5 shows an example of the equipment used for working the present invention.

The manganese removal treatment according to the present invention is preferably conducted in equipment as shown in FIG. 5.

In FIG. 5, 1 is a ladle receiving molten pig iron 2, and this ladle is transferred by a crane (not shown). In this drawing, the ladle is shown in a tilted state for charging the molten pig iron 2 into a treating vessel 3. The treating vessel 3 is movably arranged on a cart 8, and is tilted by means of a tilting device (not shown) so as to discharge the content, specifically oxidizing slag, in the treating vessel. The cart 8 runs on track 10 arranged on an operating floor 9. Further, this treating vessel is provided with a nozzle hole 4 at the bottom. This nozzle hole 4 is opened and closed by a conventional sliding nozzle mechanism 5, for example, so as to control the flow-out of the content in the treating vessel 3. As for the nozzle hole closing and opening mechanism, a stopper head (not shown) may be used, but in this case there is some restriction in selecting the means for forced stirring of the contents in the vessel, and the stopper head must be designed so as to be resistant against attack by the slag or molten pig iron and yet to also resist deformation due to the high temperature atmosphere.

The treating vessel 5 may be provided with any of the forced stirring devices as mentioned hereinbefore. According to the embodiment shown in this drawing, a porous plug 7 is provided for gas bubbling, an argon gas is used. Above the treating vessel 3, an addition hopper 11 is provided, in which materials, such as, iron oxide having a 0.3 to 1.0 bulk density, lime stone silica stone and fluorite, are stored in an appropriate mixing proportion for forming the oxidizing slag.

On the other hand, below the treating vessel 3, namely on the floor 12, a molten pig iron vessel 13 and an acid slag vessel 14 are arranged in such a way that they are movable in a direction crossing the running direction of the cart 8. 15 and 16 are tracks arranged on the floor.

The following is a description of the operation of the manganese removal treatment equipment of the above construction.

Of the slag making materials stored in the hopper 10, a portion corresponding to the first treatment of the molten pig iron is charged into the treating vessel 3. In this case, it is desirable that the iron oxide having a bulk density of 0.3 to 1.0 is charged in a ratio between 15 to 25 kg per ton of pig iron.

Then molten pig iron 2 is charged into the treating vessel 3, and when the content in the vessel 3 is forcedly stirred by argon gas from the porous plug 7, the slag making materials are melted by the sensible heat of the molten pig iron to form molten oxidizing slag 17 which oxidizes manganese in the molten pig iron and transfers it into the slag.

When a desired preliminary manganese removal treatment is finished, namely when the manganese content is reduced to a value lower than 0.35%, the forced stirring is stopped, and then the molten oxidizing slag 17 floats on the molten pig iron due to the gravity difference. The sliding nozzle 5 is then opened to allow the molten pig iron 2 after the treatment to flow out through the nozzle hole 4 into the molten pig iron vessel 13, and this molten pig iron is transferred to the subsequent processing step. The sliding nozzle 5 is closed before the slag 17 flows out in order to retain the molten oxidizing slag.

Thus, one aspect of the present invention includes the reuse of the slag retained in the treating vessel.

Namely, the slag making materials are charged in the treating vessel 3 in which the molten slag has been retained in an amount sufficient to make up for the consumption of the slag by the previous treatment. This consumption making-up amount is usually small. Then fresh molten pig iron is again charged into the vessel and forcedly stirred to effect manganese removal treatment of the molten pig iron. The slag making materials charged during this treatment are a relatively small amount and are charged into the slag which is in a molten state, and thus the slag making materials are very readily melted. When the second manganese removal treatment is finished, the sliding nozzle 5 is opened just as in the previous treatment to allow the molten pig iron thus treated to flow out into the molten pig iron vessel 13 and transferred to the subsequent step.

However, if the above treatment is repeated several times as above, a large amount of slag remains in the treating vessel 3 so that the amount of molten pig iron to be charged next must be correspondingly smaller. Thus, the slag is discharged in such a way as to retain an appropriate amount in the treating vessel 3. In this way, the preliminary manganese removal treatment of the molten pig iron is resumed again.

As described above, as the molten oxidizing slag after the preliminary manganese removal treatment is retained in the treating vessel and this retained slag is used again for the next manganese removal treatment using the equipment as shown in FIG. 5, it is possible to reduce the unit cost of the slag making materials (principally iron oxide) and it is further possible to reduce the amount of the slag making materials compared to those used in previus treatments, and save the heat required for melting the slag making materials because they are charged into slag which is in the molten state, thus reducing the temperature decrease of the molten pig iron during the treatment. Further, as the slag is not discharged with every manganese removal treatment, the efficiency of the manganese removal treatment is very high.

Next the molten pig iron, having the manganese content decreased to 0.10 to 0.35%, is charged to a convertor and subjected to a conventional oxygen blowing treatment. The supply of oxygen is stopped at the moment when the carbon content becomes about 0.030%, but not less. At that time, the content of manganese is 0.01 to 0.065%, the content of oxygen, less than 1000 ppm and the content of nitrogen, less than 35 ppm in the finished steel.

The molten steel obtained by the convertor blowing and containing not less than 0.030% C, not more than 0.065% Mn, and not more than 1000 ppm [O] is treated with the addition of Si and if necessary one or more of Mn, S, Al, Se, N, Sb, V, Cu, P, Ti and Cr as impurities for forming the precipitated dispersion to obtain a steel having a chemical composition of 0.005 to 0.06% C, 2.5 to 4.0% Si and not more than 0.075% Mn, and this steel is subsequently cast by a continuous casting process or an ingot casting process.

Slabs obtained by the continuous casting are made into final products by an ordinary production method for making grain-oriented electrical steel sheets (strips).

The reasons for limitations of the compositions are set forth herein are as follows:

1. Molten Pig Iron Stage:

The upper limit of the manganese content is 0.35% and the lower limit of the carbon content is 4.0%. These conditions are necessary to satisfy the final requirements in the state of the blown-off molten steel of not more than 0.065% manganese, not less than 0.030% carbon, and not more than 1000 ppm of oxygen.

The lowest value of the manganese in the molten pig iron is 0.10%. Thus, the maximum amount of iron oxide powder having a bulk density in the range from 0.3 to 1.0 which can be added is not more than 25 kg per ton of pig iron. The addition of amounts greater than this result in too large a temperature decrease in the molten pig iron. The addition of 25 kg per ton of pig iron corresponds to a minimum value of manganese of 0.10%.

The upper limit of the carbon in the molten pig iron is not critical. Thus, the amount of carbon which is reduced by contacting the molten pig iron with iron oxide powder is 0.2% at most.

2. In the Molten Steel:

The upper limit for the manganese is 0.065%. Manganese sulfide is utilized as a precipitated dispersion phase for the secondary recrystallization in the stage of the final high temperature annealing. The solubilization of the manganese sulfide becomes very difficult in the slab reheating when the manganese content in the slab is greater than 0.08%. Thus, the manganese sulfide precipitated in the stage of a hot coiling would be insufficient and as a result, the secondary recrystallization would also be insufficient.

Considering the pick-up of manganese in the course of tapping (which is about 0.015% maximum), the manganese content of the molten steel is restricted to not more than 0.65%.

While the solubilization of the manganese sulfide can be made possible by elevating the temperature of the slab reheating, this results in the hot coil structure becoming abnormal and again, the secondary recrystallization would be insufficient.

The lower limit of the carbon content is 0.03%. When the carbon content is less than this value, the secondary recrystallization structure becomes abnormal in the final high temperature annealing, so that the secondary recrystallization crystals become unstable and the magnetic characteristics deteriorate.

With the oxygen content of more than 1000 ppm, the amount of nonmetallic inclusions, even after deoxidation treatment, produce significant deterioration in the magnetic characteristics of the steel.

With respect to the lower limit of the manganese content, if the carbon content is less than 0.03% and the oxygen content is more than 1000 ppm, the amount of manganese sulfide becomes insufficient for utilization as a precipitation dispersion phase. Thus, the lower limit of manganese is 0.04% or, when considering the pick-up during the course of tapping, 0.03%.

When the carbon content is more than 0.06%, the decarburization annealing requires a much longer time and thus produces economic disadvantages.

While the silicon content is of the same order of magnitude as conventional grain-oriented electrical steel sheets, the iron loss increases when the content is less than 2% and the steel becomes brittle and is cold rolled with difficulty when the content is more than 4%. Consequently, silicon is usually present in the ranges from about 2 to 4 percent.

The present invention will be more clearly understood from the following examples.

EXAMPLE 1

15 kg per ton of pig iron of iron oxide (sludge) having a bulk density of 0.7 and 5 kg per ton of pig iron of fluorite and 5 kg per ton of pig iron of silica stone as a slag adjusting agent were charged to a treating ladle, provided with a porous plug for argon gas bubbling, and then molten pig iron prepared in a blast furnace and containing 4.50% C, 0.70% Mn, 0.105% P, and 0.03% S, was charged into the ladle at 1370° C, and the mixture was stirred with argon bubbling to obtain manganese reduced molten pig iron containing 4.5% C, 0.25% Mn, 0.105% P, 0.030% S, and having a temperature of 1340° C.

Figure 4:
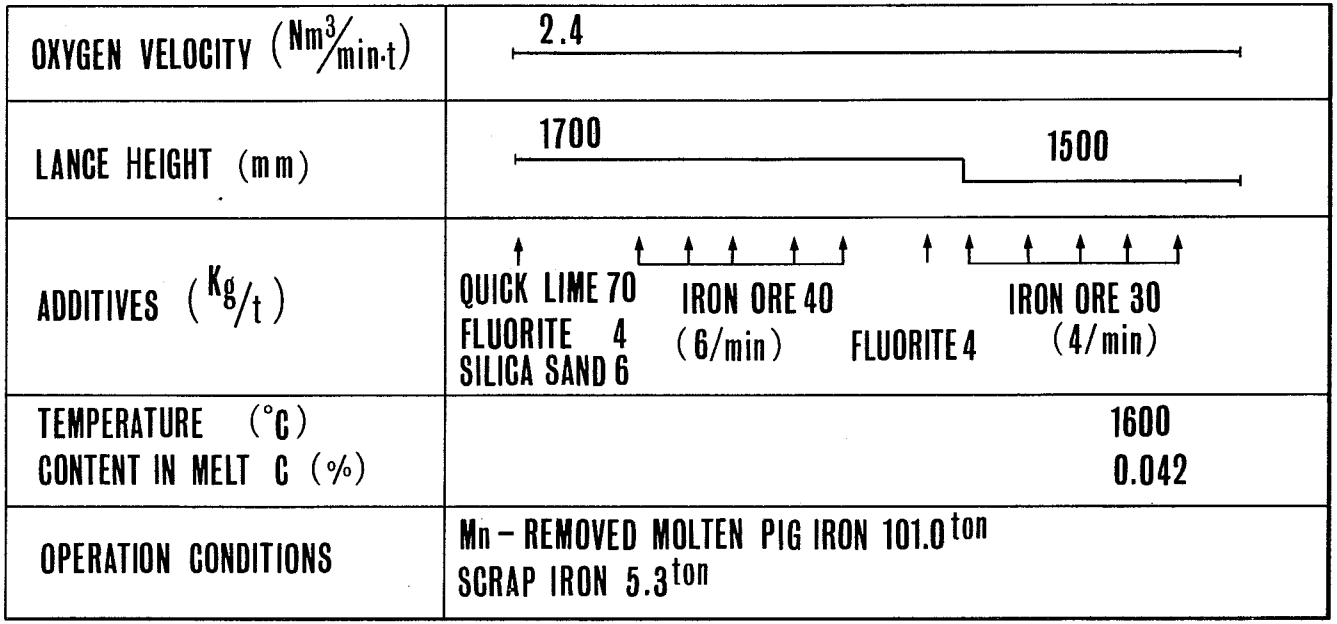
FIG. 4 shows an example of the blowing pattern of the present invention.

This manganese removed molten pig iron was charged into a convertor of 100 ton/charge capacity together with 3.5 tons of scrap iron and subjected to convertor blowing according to the blowing pattern shown in FIG. 4. The results and magnetic properties of the steel thus obtained are shown under in comparison with those obtained by the blowing disclosed in the Japanese Patent Publication Sho 48-19044.

| | | C(%) | [O](ppm) | Mn(%) | S(%) | Si(%) | N(ppm) | Temperature (° C) |
|---|---|---|---|---|---|---|---|---|
| Present Invention | Blown-off | 0.042 | 860 | 0.040 | 0.016 | trace | 30 | 1600 |
| | Final | 0.045 | | 0.048 | 0.017 | 3.10 | 39 | |
| Comparative | Blown-off | 0.042 | 1090 | 0.041 | 0.016 | trace | 52 | 1620 |
| | Final | 0.040 | | 0.055 | 0.017 | 3.10 | 62 | |

| | Proportion of Molten Pig Iron (%) | Blowing Time (minute) | Tapping Yield (%) | Oxygent Consumption ($Nm^3$/T-steel) | Magnetic Flux*1 Density of Steel Product (B8 wb/$m^2$) | Watt Loss*1 of Steel Product ($w^{17}/50$) | Blister*2 Occurrence (%) |
|---|---|---|---|---|---|---|---|
| Present Invention | 95.0 | 41.7 | 94.9 | 44.6 | 1.842 | 1.237 | 0 |
| Comparative | 95.0 | 54.4 | 89.4 | 53.7 | 1.827 | 1.283 | 5.5 |

Remarks
*1Plate thickness 0.3 mm
*2Determined by the presence of blister in a section of 20 cm × 200 mm As clearly understood from the above, the steel obtained by the present invention has a smaller amount of [O] than the steel of the Japanese patent publication Sho 48-19044, and the magnetic properties of the steel obtained by the present invention are completely satisfactory.

Also, no blister occurs even when the steel is continuously cast because the N content in the molten steel is maintained at a low level. Further, the blowing time is remarkably shortened by the present invention as compared with that of the Japanese patent publication Sho 48-19044 and thus the advantage in the convertor process is remarkable.

Still further, the steel yield is also remarkably improved by the present invention as compared with the Japanese patent publication Sho 48-19044 thus saving the oxygen consumption.

EXAMPLE 2

For the production of steel for grain-oriented electrical steel sheet by the convertor blowing process according to the present invention, iron oxide (red oxide) having a bulk density of 0.4 as a slag making material was charged into treating vessel 3 in a ratio of 20 kg per ton of pig iron using the equipment as shown in FIG. 5 for the purpose of preliminary treatment of the molten pig iron to obtain a manganese content not more than 0.35%, and then 70 tons of molten pig iron was charged and forcedly sitrred by argon gas bubbling to effect manganese removal. The chemical analysis of the molten pig iron prior to the treatment was 4.2% C, 0.55% Mn, 0.110% P, and 0.25% S, while the Mn content after the treatment was 0.27% with a manganese removal efficiency of about 50%.

Then, only the molten oxidizing slag after the preliminary manganese removal treatment was retained in the treating vessel, and further, 70 tons of fresh molten pig iron of the same composition as above together with 5 kg/t-pig iron of iron oxide (red oxide) were additionally charged, and the same treatment as above was reported. The manganese content after the treatment was 0.29%, with a manganese removal efficiency of about 48%.

Then again, only the molten oxidizing slag after the second preliminary manganese removal treatment was retained in the treating vessel, and 70 tons of fresh molten pig iron of the same composition as above were charged together with 3 kg/ton of pig rion of iron oxide (red oxide) having a bulk density of 0.4, and the same treatment as above was conducted. The Mn content after the treatment was 0.31% with a manganese removal efficiency of about 45%. After the third treatment, the amount of slag in the treating vessel 3 was too large to use it for the subsequent treatment, and thus, it was discharged from the treating vessel 3. The Mn content in all of the molten pig iron obtained by the above treatments was not more than 0.35%, and satisfactory molten steel according to the present invention was obtained by the subsequent convertor blowing. The consumption of the slag in the preliminary manganese treatments was 36.8%.

The Mn contents after the oxygen blowing in the convertor of the molten pig irons treated by the first, second and third treatments were as follows and excellent magnetic properties were exhibited by sheets manufactured from these compositions.

| | Mn content (%) | *$B_8$(wb/m$^2$) | *Watt loss (w 17/50) | Blister occurrence |
|---|---|---|---|---|
| First | 0.046 | 1.845 | 1.231 | 0 |
| Second | 0.049 | 1.837 | 1.251 | 0 |
| Third | 0.050 | 1.836 | 1.249 | 0 |

*plate thickness 0.3 mm

As understood from the above descriptions the present invention provide considerable advantages for the convertor processing of steel for grain-oriented electrical steel sheets.

What is claimed is:

1. In a method for preparing grain-oriented electrical refined in strip of the type wherein molten pig iron is refined in a pure oxygen top-blown convertor to produce blown-off molten steel which is then subjected to conventional casting, rolling, and annealing and heating treatments, the improvement which comprises prior to said refining step, contacting, with stirring, the molten pig iron with an oxidizing slag of iron oxide powder having a bulk density between 0.3 and 1.0 in an amount from 15 to 25 kg per ton of pig iron to adjust the carbon content of the pig iron to not less than 4.0 percent and the manganese content to from about 0.10 to 0.35 percent, separating molten oxidizing slag from the pig iron, and then transferring the thus treated pig iron to said refining and casting steps, whereby the blown-off molten steel has not more than 0.065 percent manganese, not less than 0.030 percent carbon, and not more than 1000 ppm oxygen.

2. The method of claim 1, wherein the separated molten oxidizing slag is reused for treating another batch of molten pig iron.

3. The method of claim 2, wherein additional iron oxide powder having a bulk density from about 0.3 to 1.0 is added as make-up to the separated molten oxidizing slag.

4. The method of claim 1, wherein the blown-off molten steel contains less than 35 ppm nitrogen.

5. The method of claim 1, wherein the stirring is carried out by bubbling argon gas up through the molten pig iron.

* * * * *